US006919014B2

(12) United States Patent
Schulz et al.

(10) Patent No.: US 6,919,014 B2
(45) Date of Patent: Jul. 19, 2005

(54) SATIN-FINISHED NICKEL OR NICKEL ALLOY COATING

(75) Inventors: Klaus-Dieter Schulz, Berlin (DE); Wolfgang Dahms, Berlin (DE); Holger Weide, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 179 days.

(21) Appl. No.: 10/276,090

(22) PCT Filed: May 9, 2001

(86) PCT No.: PCT/EP01/05286

§ 371 (c)(1),
(2), (4) Date: Mar. 17, 2003

(87) PCT Pub. No.: WO01/88227

PCT Pub. Date: Nov. 22, 2001

(65) Prior Publication Data

US 2003/0159940 A1 Aug. 28, 2003

(30) Foreign Application Priority Data

May 19, 2000 (DE) ..... 100 25 552

(51) Int. Cl.[7] ..... C25D 3/56; C25D 3/12
(52) U.S. Cl. ..... 205/259; 205/260; 205/271
(58) Field of Search ..... 205/259, 260, 205/271, 273, 280

(56) References Cited

U.S. PATENT DOCUMENTS

| | | | | |
|---|---|---|---|---|
| 3,255,096 | A | 6/1966 | Towle et al. | 204/49 |
| 4,526,968 | A | 7/1985 | Lemke et al. | 546/139 |

FOREIGN PATENT DOCUMENTS

| | | | |
|---|---|---|---|
| CZ | 241664 | B1 * | 4/1986 |
| CZ | 241666 | B1 * | 4/1986 |
| DE | 1621085 | | 6/1967 |
| DE | 1621087 | | 8/1967 |
| DE | 2134457 | C2 | 7/1970 |
| DE | 2327881 | A1 | 5/1973 |
| DE | 2522130 | B1 | 5/1975 |
| DE | 3736171 | A1 | 10/1987 |
| DE | 195 40 011 | A1 | 10/1995 |
| JP | 56152988 | | 11/1981 |
| JP | 08260186 | | 10/1996 |
| JP | 11001791 | | 1/1999 |

OTHER PUBLICATIONS

Huang, Chein Ho, "The Effect of Organic Additives on the Electroformed Nickel Alloys", Interfinish 92, Int. Congr. Surf. Finish. (no month, 1992), vol. 3, pp. 1396–1405. Abstract Only.*

Spezialchemikalien der BASF Tenside und Polyalkylenglykole, no date.

* cited by examiner

*Primary Examiner*—Edna Wong
(74) *Attorney, Agent, or Firm*—Frank J. Bonini, Jr.; John F. A. Earley, III; Harding, Earley, Follmer & Frailey

(57) ABSTRACT

In order to achieve an even satin-finished nickel or nickel alloy coating an acid nickel or nickel alloy electroplating bath is proposed which contains a sulfosuccinic acid compound of the general formula I additional to at least one quaternary ammonium compound, wherein $R_1$, $R_2$=hydrogen ion, alkali ion, alkaline earth ion, ammonium ion and/or $C_1$–$C_{18}$ hydrocarbon moiety, wherein $R_1$ and $R_2$ are identical or different with the proviso that at the most one of the groups $R_1$ and $R_2$=hydrogen ion, alkali ion and alkaline earth ion, and wherein $K^+$=hydrogen ion, alkaline ion, alkaline earth ion, ammonium ion (I)

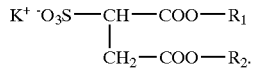

11 Claims, No Drawings

SATIN-FINISHED NICKEL OR NICKEL ALLOY COATING

BACKGROUND OF THE INVENTION

1. Field of the Invention

The invention relates to an acid nickel or nickel alloy electroplating bath and to a method for depositing a satin-finished nickel or nickel alloy coating.

2. Brief Description of the Related Art

Predominantly bright nickel or nickel alloy coatings which moreover should be well levelled are used in industry. However, it has been recognized early that satin-finished coatings may look esthetically and at the same time prevent from dazzling. When combined with semi-bright nickel coatings and with a chromium coating such coatings are just as corrosion preventing as a bright nickel coating. These satin-finished nickel coatings are therefore often used in automotive industry, in precision mechanics industry, for sanitary appliances as well as for furniture mountings.

Up to now nickel coatings can be produced with various methods:

It has been indicated in DE-OS 1 621 085 that the surface of the metal to be coated could first be roughened by means of sandblasting. Afterwards the surface would then be treated with a common electroplating bath to deposit a bright nickel layer. According to another method first a bright nickel coating could be provided with a mat finish by means of mechanical treatment. Due to this treatment, however, the corrosion resistance would be reduced considerably because the nickel layer would be weakened. It is further indicated that both methods described would suffer from being very complicated and expensive due to the mechanical treatment. Other methods are described in this document which allow deposition of satin-finished nickel coatings directly from the electroplating bath without any preceding or succeeding mechanical treatment.

For this purpose finely grinded material which is insoluble in these baths, such as for example kaolin, graphite, barium sulfate, glass, talcum powder, calcium oxalate and other substances, with a particle size of from 0.1 to 0.3 $\mu$m are added to the common nickel electroplating baths in considerable amounts. By intensively blowing air through the baths these substances are held in suspension and will be codeposited into the coating as nickel is deposited. It is indicated in this document that a certain roughness of the coating would emerge establishing satin-finished appearance. This method, however, would require a specific apparatus for carrying out the method, since the method could not be performed in conventional electroplating devices. For this reason additional costs would arise.

Because of the drawbacks of the conventional methods an acid nickel electroplating bath for the production of satin-finished nickel coatings is disclosed in DE-OS 1 621 985 as an improvement over the described methods in this document. For performing this method a bath is required that, additional to basic brightening compounds, contains substituted or unsubstituted ethylene oxide or propylene oxide or ethylene oxide propylene oxide adducts at a concentration of from 5 to 100 mg/l, these additional adducts being able to form a finely dispersed emulsion in the bath solution at a temperature of from 40 to 75° C.

Further an acid nickel, nickel/cobalt or nickel/iron electroplating bath are described in DE 25 22 130 B1, these baths being suitable for the deposition of satin-finished coatings. This bath contains liquid polysiloxane polyoxyalkylene block polymers in an emulsion in addition to primary and/or secondary brighteners.

Nickel coatings that are known from the disclosure in DE-OS 1 621 085 can be produced according to the method as described in DE-AS 1 621 087. Coatings exhibiting even satin-finish can be produced by cooling the bath liquid completely or partly below cloud temperature and subsequent heating the liquid to the working temperature again. Upon exceeding the cloud temperature nonionic surfactants precipitate due to the fact that the surfactants lose their hydrate sheath. The emulsified droplets formed are dissolved upon cooling the liquid and will once more be formed upon anewed heating. The nickel deposition is impaired selectively by precipitating droplets of the surfactant, without the droplets essentially being included into the nickel coating. The fact that much energy must be spent for heating and cooling the plating liquid as well as for pumping the liquid makes this method disadvantageous. Furthermore the maximum bath volume is limited to a certain value since the expenditure for heating and cooling the liquid and for pumping the liquid raises considerably if the bath volume exceeds 8.000 l. Under these conditions operation of the method is no longer economical. Moreover after a short time of carrying out this method lumps of the surfactants are formed in the bath solution which cause pores to be produced in the nickel coatings.

Due to the drawbacks mentioned above the method for producing semi-bright nickel or nickel/cobalt coatings as described in DE 23 27 881 A1 has been successful. In this method the mat coatings are generated by incorporating foreign matter into the coatings. The foreign matter is produced by bringing together cationic or amphoteric substances with organic anions. Quaternary ammonium compounds, derivatives of imidazolines, alkanolamine esters and surface active agents based on amino carboxylic acids are proposed in this document as cationic or amphoteric substances. By bringing together the cationic or amphoteric substances with the organic anions an emulsion is formed which together with basic brighteners being present in the nickel electroplating bath leading to a satin-finish by imparing nickel deposition.

Unfortunately this method also suffers from certain drawbacks: Within about three to five hours after making up the electroplating bath the surface of deposited nickel coatings becomes more and more rough. In part even visually detectable coarse nickel crystals appear on the surface which are not acceptable as to the appearance of the nickel surface. Therefore at least before eight hours of production have passed the bath liquid must be worked up by completely filtrating and cleaning it with filter material, such as for example cellulose, diatomaceous earth or even with activated carbon. The production break required for working the bath liquid up is especially very troublesome and expensive if a continuous plant is operated. Moreover a removable "silver layer" is generated if afterwards a chromium layer is deposited for 10 minutes or longer.

Several attempts have been made to get rid of the shortcomings mentioned. Therefore in DE 37 36 171 A1 a method for the deposition of satin-finished nickel coatings is described, the nickel bath liquid used for carrying out this method containing inter alia one or more basic brighteners, one or more anionic surfactants, one or more organic emulsion formers, one or more quaternary ammonium compounds as well as one or more acyclic or aromatic sulfinic acids. Preferably benzoic acid sulfimide, m-benzenedisulfonic acid, naphthalenetrisulfonic acid, diaryldisulfides, sulfonamides and N-sulfonyl carboxamides as well as the salts thereof being soluble in water are to be understood as basic brighteners. However, upon carrying out this method coatings with a constant appearance cannot be achieved without heating and cooling the bath liquid as before.

A further electroplating method for producing nickel coatings that have a non-dazzling appearance is disclosed in DE 195 40 011 A1. According to this document a nickel bath is used, that contains inter alia basic brighteners, organic sulfinic acids as well as surfactants. Additionally the bath contains substituted and/or unsubstituted ethylene oxide adducts or propylene oxide adducts or ethylene oxide propylene oxide adducts at such a low concentration that cloudiness is not visually detectable at the working temperature of the bath. The use of nonionic surfactants at the concentration indicated in this document does not guarantee, however, since their efficiency quickly diminishes and since the appearance of the coatings quickly changes.

Further an aqueous electroplating bath for depositing bright nickel or nickel/cobalt coatings is described in DE 21 34 457 C2. According to several examples in this document sulfosuccinic acid esters are added to the bath liquid which additionally contains saccharin as a secondary brightener. However, satin-finished nickel coatings were not produced with these baths. Furthermore a nickel bath for depositing satin-finished coatings is disclosed in Patent Abstracts of Japan, JP 56152988 A which contains surfactants selected from the group comprising alkyl aryl sulfonates and sulfosuccinic acid esters additional to saccharin as a brightener and ethylene oxide propylene oxide block polymer. In this case too it has be established that a satin-finished nickel coating could only be produced within a short period after the bath has been made up. After this period coatings were generated which exhibit a rough surface.

All methods described can only be carried out during a few hours. Within this period nickel coatings with more or less satisfactory satin-finish are obtainable. However, during this period of time roughness increases. After expiry of this period only rough nickel coatings can be deposited which are porous.

The problem of the present invention therefore consists in avoiding the disadvantages of the known electroplating baths and especially in finding an electroplating bath suitable for the production of a satin-finished nickel or nickel alloy coating and a method for producing satin-finished nickel coatings. When using this method it should be possible to generate nickel coatings with constant surface quality within a long period of time after the electroplating bath has been made up without the necessity to clean the bath liquid or work the bath up with any other means with excessive expenditure.

SUMMARY OF THE INVENTION

Surprisingly it has been found out that satin-finished coatings can be obtained on the surface of nickel and nickel alloy layers being deposited at any point of time within a long period of time after make up of the bath, if one or more sulfosuccinic acid compounds are added to a nickel electroplating bath, which additionally contains at least one quaternary ammonium compound and at least one anionic basic brightener, the sulfosuccinic acid compound having the following general formula (I):

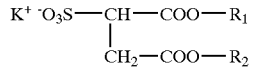

(I)

wherein $R_1$, $R_2$ hydrogen ion, alkali ion, alkaline earth ion, ammonium ion and/or $C_1$–$C_{18}$ hydrocarbon moiety, wherein $R_1$ and $R_2$ are identical or different with the proviso that at the most one of the groups $R_1$ and $R_2$=hydrogen ion, alkali ion, ammonium ion and alkaline earth ion, and wherein $K^+$=hydrogen ion, alkaline ion, alkaline earth ion, ammonium ion.

The constancy of nickel electroplating is likely to be the result of the stability of the ion pair crystals being formed from the quaternary ammonium compounds and the anionic basic brighteners, which constancy may even be enhanced by at least twice by employing the sulfosuccinic acid compounds. The efficiency of the sulfosuccinic acid compounds in accordance with the inventive purpose obviously results from the effect of these compounds act as a co-dispersant for the ion pair crystals as mentioned. This also results from the fact that even a low concentration of the sulfosuccinic acid compounds in the elctroplating bath is sufficient to assure the effect according to the invention. By adding the sulfosuccinic acid compounds to the electroplating bath it is possible for the first time to operate the bath for days with a partial current filtration.

The present invention is not related to mat nickel electroplating baths.

There are a variety of advantages of the nickel or nickel alloy electroplating baths according to the present invention:

1. The stability of the dispersion formed in the electroplating bath is improved by at least twice the continuous operating time compared to conventional baths.
2. An operation for days is possible by means of partial current filtration.
3. Formation of a removable "silver layer" upon chromium plating is prevented.
4. The satin-finished appearance is enhanced by addition of the sulfosuccinic acid compounds. This is appreciated by those applicants who want to deposit nickel or nickel alloy coatings with a substantial satin-finish. Up to now such an appearance was only achieved by adding quaternary ammonium compounds in considerable amounts to the nickel electroplating bath. However under these conditions bath life was reduced.

DETAILED DESCRIPTION OF THE PREFERRED EMBODIMENTS

At least one of the $C_1$–$C_{18}$ hydrocarbon moieties of the sulfosuccinic acid compound I is preferably an acyclic or cyclic hydrocarbon moiety or a group of hydrocarbon moieties bridged via ether groups. The $C_1$–$C_{18}$ moieties are preferably acyclic linear or unbranched moieties or cyclic moieties. If necessary these moieties may also be unsaturated hydrocarbon moieties or groups of at least partly unsaturated hydrocarbon moieties bridged via ether groups.

The compounds listed in table 1 have proven a success when they are employed in an nickel or nickel alloy electroplating bath.

TABLE 1

| | Sulfosuccinic acid compounds |
|---|---|
| 1 | Sulfosuccinic acid di(n-propyl) ester |
| 2 | Sulfosuccinic acid di(iso-propyl) ester |
| 3 | Sulfosuccinic acid di(n-butyl) ester |
| 4 | Sulfosuccinic acid di(iso-butyl) ester |
| 5 | Sulfosuccinic acid di(n-pentyl) ester |
| 6 | Sulfosuccinic acid di(iso-pentyl) ester |

TABLE 1-continued

| Sulfosuccinic acid compounds | |
|---|---|
| 7 | Sulfosuccinic acid di(n-hexyl) ester |
| 8 | Sulfosuccinic acid di(iso-hexyl) ester |
| 9 | Sulfosuccinic acid bis-(1,3-dimethylbutyl) ester |
| 10 | Sulfosuccinic acid dicyclohexyl ester |
| 11 | Sulfosuccinic acid di(n-octyl) ester |
| 12 | Sulfosuccinic acid di(iso-octyl) ester |
| 13 | Sulfosuccinic acid bis(2-ethylhexyl) ester |
| 14 | Sulfosuccinic acid dinonyl ester |
| 15 | Sulfosuccinic acid monolauryl ester |
| 16 | Sulfosuccinic acid dilauryl ester |
| 17 | Sulfosuccinic acid monododecenyl ester |
| 18 | Sulfosuccinic acid dihexadecyl ester |
| 19 | Fatty alcohol polyglycol ether ester of sulfosuccinic acid |
| 20 | Sulfosuccinic acid mono (oxodiethyoxydodecyl) ester (lauryl alcohol polyglycol ether ester of sulfosuccinic acid) |

The alkyl ester group may especially comprise all isomers. For example the propyl ester comprises n-propyl ester and iso-propyl ester, the butyl ester comprises n-butyl ester, iso-butyl ester and tert butyl ester and the pentyl ester comprises the n-pentyl ester, the isopentyl ester, the tert.-pentyl ester and the neo-pentyl ester.

Both free sulfonic acid and the sodium, potassium and magnesium or ammonium salts thereof may be employed. Usually the sodium salts of the sulfonic acid are used. Furthermore also several sulfosuccinic acid compounds may be used.

The concentration of the sulfosuccinic acid compounds in the nickel or nickel alloy electroplating baths is very low and may be varied in the range from 0.005 to 5 g/l and normally of from 0.005 to 0.05 g/l. The concentration of the sulfosuccinic acid compounds is preferably near the upper limit of the preferred concentration range (up to 0.05 g/l) if the effect to be achieved should last as long as possible. It has to be considered that commercially available substances are rarely pure to 100%, but normally contain water and sometimes also lower alcohols as solubilizers. The aforementioned concentrations refer to substances with a purity of 100%.

The bath liquid provided for the electroplating of nickel or nickel alloy deposits usually comprises a nickel salt solution which additionally contains a weak acid as a buffer substance in addition to the substances in accordance to the present invention.

In general practice a so-called Watts electrolyte is used, which has about the following composition:

330–550 g/l nickel sulfate ($NiSO_4.7\ H_2O$)

30–150 g/l nickel chloride ($NiCl_2.6\ H_2O$)

30–50 g/l boric acid ($H_3BO_3$)

The pH of the electrolyte solution may be set in the range from 3 to 5.5, mainly from 3.8 to 4.4. In order to be able to set a current density as high as possible the temperature may amount up to 75° C. In general it is set in the range from 50° C. to 60° C.

Nickel and nickel alloy electroplating baths have a chloride content of from 10 to 50 g/l. The best results are obtained with baths with a concentration in this range. Nickel chloride may be replaced partly or entirely by sodium chloride. Chloride in the electrolyte may be replaced partly or entirely by equivalent amounts of bromide. Nickel salts in the electroplating bath can be replaced at least partly by cobalt salts or at least one cobalt ion source may be added to the bath in order to be able to deposit a nickel/cobalt alloy coating. The cathodic current density may amount to values up to 10 A/dm$^2$ if the temperature amounts to 55° C. and if a high-performance electroplating bath as mentioned is employed. Usually the current density is set to 3 to 6. A/dm$^2$. The dwell time in the nickel electroplating bath should amount to at least 9 minutes under the conditions given.

In principle sulfosuccinic acid compounds may be added to the bath without any other bath additives to be added too. However, sufficient long-time stability of the baths can only be achieved if a combination of the sulfosuccinic acid compounds is used together with quaternary ammonium compounds and if necessary with additional basic brighteners. Under these circumstances an excellent satin-finish of nickel or nickel alloy surfaces is achieved over the entire current density range operable under practical conditions. This excellent satin-finish may be achieved constantly at least during 15 hours of operation of the electroplating bath. Furthermore plating under the mentioned conditions does not lead to removable haze on a chromium plated layer on top of the nickel or nickel alloy coating even if a long chromium plating time is set.

The quaternary ammonium compounds contained in the nickel or nickel alloy bath are cationic surface active agents having the following general formula (II):

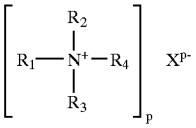

(II)

wherein $R_1$, $R_2$ and $R_3$=hydrogen and/or acyclic $C_1$–$C_{18}$ hydrocarbon moiety, wherein $R_1$, $R_2$ and $R_3$ are identical or different with the proviso that at most two of the moieties $R_1$, $R_2$ and R=hydrogen;

$R_4$=hydrogen, acyclic $C_1$–$C_4$ hydrocarbon moiety or $C_1$–$C_4$ hydrocarbon moiety substituted with an aromatic group, for example benzyl;

$X^{p-}$=monovalent or multivalent anion, for example chloride, bromide, formate or sulfate; and p=an integer.

$R_1$, $R_2$ and $R_3$ are linear or branched saturated and if necessary unsaturated $C_1$–$C_{18}$ hydrocarbon moieties. Mixtures of hydrocarbon moieties of naturally occuring acids, such as for example the tallo, cocosyl, myristyl and lauryl moiety, may advantageously be employed.

Examples of the quaternary compounds are given in table 2:

TABLE 2

| Quaternary ammonium compounds | |
|---|---|
| 1 | dioctyldimethyl ammonium chloride |
| 2 | didecyldimethyl ammonium chloride |
| 3 | didodecyldimethyl ammonium bromide |
| 4 | dodecyl dimethylbenzyl ammonium chloride |
| 5 | tetradecyldimethylbenzyl ammonium chloride |
| 6 | hexadecyldimethylbenzyl ammonium chloride |
| 7 | cocosyldimethylbenzyl ammonium chloride |
| 8 | stearyldimethylbenzyl ammonium chloride |
| 9 | oleyldimethylbenzyl ammonium chloride |
| 10 | dilauryldimethyl ammonium bromide |

The concentration of the quaternary ammonium compounds is set to a value in the range from 0.1 to 100 mg/l, preferably from 2.5 to 15 mg/l. Surfactants commonly used for preventing the deposition of porous coatings are not added to the nickel or nickel alloy electroplating bath. Most of these compounds impair the nickel or nickel alloy deposition. The goods to be plated are slowly moved in the plating bath. An additional aeration of the plating solution is seldomly employed. Circulating pumps and if necessary an overflow are frequently required. These improve the evenness of the satin-finished nickel or nickel alloy layer.

Further basic brighteners may preferably be added to the nickel or nickel alloy electroplating bath. Unsaturated, in most cases aromatic sulfonic acids, sulfonamides, sulfimides, N-sulfonylcarboxamides, sulfinates, diarylsulfones or the salts thereof are to be understood as basic brighteners. The most familiar compounds are for example m-benzenedisulfonic acid, benzoic acid sulfimide (saccharin), trisodium-1,3,6-naphthalenetrisulfonate, sodium benzene monosulfonate, dibenzene sulfonamide and sodium benzene monosulfinate.

Known basic brighteners are given in table 3. Mostly the sodium or potassium salts thereof are used. Furthermore it is also possible to employ several basic brighteners at the same time.

TABLE 3

| | Basic brighteners |
|---|---|
| 1 | m-benzenedisulfonic acid |
| 2 | vinylsulfonic acid |
| 3 | allylsulfonic acid |
| 4 | propinsulfonic acid |
| 5 | p-toluenesulfonic acid |
| 6 | p-toluenesulfonamide |
| 7 | benzoic acid sulfimide |
| 8 | 1,3,6-naphthalenetrisulfonic acid |
| 9 | N-benzoylbenzenesulfonamide |

The basic brighteners given in table 3 are employed and added to the electrolyte bath at a concentration of from 5 mg/l to 10 g/l, preferably of from 0.5 to 2 g/l. If merely the basic brighteners are added to the Watts basic preparation a bright deposit is obtained within a limited current density range. Therefore mere application of the basic brightener without addition of any other additive has no practical importance. Only by further addition of quaternary ammonium compounds the satin-finish as wanted is achieved.

Satin-finished nickel or nickel alloy layers are produced on an electrically conductive work piece, for example on a work piece consisting of a metal, with a method, comprising the following method steps:

a. bringing the work piece into contact with a nickel or nickel alloy electroplating according to the present invention;

b. bringing at least one anode into contact with the nickel or nickel alloy electroplating bath;

c. applying a voltage across the work piece and the at least one anode; and d. electrodepositing a satin-finished nickel or nickel alloy coating on the work piece.

In order to achieve a satin-finished surface as stable as possible it is necessary to circulate and/or filtrate the bath solution continuously or intermittently. This means that parts of the bath solution is either continuously or from time to time passed out of the electroplating container and recirculated back to the bath container again. If necessary the bath solution is filtrated when it has left the bath container. Due to this operation bigger lumps of ion pair crystallites, these crystallites in general being necessary to produce the satin-finished surface, are removed from the bath solution in order to maintain the mean particle size of these crystallites continuously under a certain critical value.

In the following examples are given to more clearly describe the present invention:

EXAMPLE 1.0

To an electrolyte solution having the following composition:

370 g/l nickel sulfate ($NiSO_4.7\ H_2O$)

40 g/l nickel chloride ($NiCl_2.6\ H_2O$)

40 g/l boric acid ($H_3BO_3$)

3 g/l sodium salt of benzoic acid sulfimide (basic brightener; compound I)

are first added 0.006 g/l didodecyldimethyl ammonium bromide (quaternary ammonium compound II).

The electrolyte solution was examined in a 100 l sized container being equipped with a mechanism for translational motion of the goods and maintaining the bath solution at a temperature of 55° C. For this purpose a scratched and 7 cm×20 cm sized copper sheet was electroplated for 17 minutes at a cathodic current density of 2.5 A/dm$^2$. An even satin-finished nickel coating was produced on the whole surface area of the copper sheet. Neither pits nor black pores were visible. This procedure was repeated each hour, the electroplated sheets being compared to each other. Already after a time period of 4 hours a coarse surface appearance of the nickel coatings was detected. After a 5 hour period the experiment was stopped since the coatings meanwhile had become unsightly (uneven, mat).

EXAMPLE 1.1

First 0.02 g/l sulfosuccinic acid bis-(1,3-dimethylbutyl)-ester (compound I) and further 0.006 g/l didodecyldimethyl ammonium bromide (compound II) were added to the electrolyte solution of example 1.0.

The examination of the electroplating bath was carried out as described in example 1.0. An even satin-finished appearance was detected on the whole surface area of the sheet electroplated with nickel. Neither pits nor black pores were visible. Electroplating was repeated each hour under the conditions as indicated above, the electroplated sheets being compared to each other. Already after a time period of 4 hours a coarse surface appearance of the nickel coatings was detected. After a 15 hour period the experiment was stopped since no change for the worse could be detected as to the appearance of surface quality of the nickel coatings produced.

Results of examples 1.0 and 1.1: Without employing compound I (sufosuccinic acid bis-(1,3-dimethylbutyl) ester) only a life time of the bath solution of 4 to 5 hours was achieved. Upon addition of compound I a life time of more than 15 hours was achieved.

EXAMPLE 2.0

To an electrolyte solution having the following composition:

450 g/l nickel sulfate ($NiSO_4.7\ H_2O$)

80 g/l nickel chloride ($NiCl_2.6\ H_2O$)

40 g/l boric acid ($H_3BO_3$)

3 g/l sodium salt of allylsulfonic acid (basic brightener)

5 g/l sodium salt of benzoic acid sulfimide (basic brightener)

were first added 0.01 g/l cocosyldimethylbenzyl ammonium chloride (quaternary ammonium compound II).

The electrolyte solution was examined in a 100 l sized container being equipped with a mechanism for translational motion of the goods and maintaining the bath solution at a temperature of 55° C. starting only after an idle time of 30 minutes. For this purpose a scratched and angled, 7 cm×20 cm sized copper sheet was electroplated for 20 minutes at a cathodic current density of 3 A/dm$^2$. Thereafter the sheet was chromium plated for 12 minutes in a commercial chromium bath (Bright Chrome CR 843, Atotech Deutschland GmbH, DE) at 40° C. at a current density of 10 A/dm$^2$.

An even satin-finished nickel coating was obtained on the whole surface area of the copper sheet. Upon looking at the surface of the nickel plated sheet towards a light source a haze could be detected (so-called "silver layer"). After operation of the nickel electroplating bath for 5 hours this faint removable haze had evolved to an easily visible haze so that production had to cease.

EXAMPLE 2.1

First 0.04 g/l sulfosuccinic acid dihexyl ester (compound I) were added to the electrolyte solution used in example 2.0. Then 0.01 g/l cocosyldimethylbenzyl ammonium chloride (quaternary ammonium compound II) was added to the solution.

The examination of this bath solution was performed as described in example 2.0. After an idle time of 30 minutes an even satin-finished nickel coating was obtained on the whole surface area of the sheet. Neither pits nor black pores were visible. Upon looking at the surface of the nickel plated sheet towards a light source no haze could be detected. Even after operation of the nickel electroplating bath for 5 hours no haze could be detected.

Result of examples 2.0 and 2.1: Addition of compound I according to the present invention (sufosuccinic acid dihexyl ester) prevented occurrence of a haze on the nickel surface even after an operation time of the bath of 5 hours.

EXAMPLE 3.0

To an Erlenmeyer flask were given the following substances succeedingly whereas the mixture was stirred:

50 ml water 1.5 g/l sodium salt of allyisulfonic acid (basic brightener)

5 g/l sodium salt of benzoic acid sulfimide (basic brightener) 20 mg/l didecyldimethyibenzyl ammonium chloride (quaternary ammonium compound II).

The surface of the solution was examined by means of a slit lamp. After about 1 hour had passed a clear scale-like, iridescent surface film appeared. The solution was turbid.

EXAMPLE 3.1

Parallel to example 3.0 the following substances were given to the Erlenmeyer flask:

50 mg water 1.5 g/l sodium salt of allylsulfonic acid (basic brightener)

5 g/l sodium salt of benzoic acid sulfimide (basic brightener)

10 mg/l sulfosuccinic acid diisooctylester (compound I).

Then upon stirring 20 mg/l dodecyldimethylbenzyl ammonium chloride (quaternary ammonium compound II) were added to this solution. Even after hours no surface film had been developed. The solution was slightly turbid.

Result of examples 3.0 and 3.1: Without employing compound I a clear scale-like iridescent surface film developed on the electrolyte solution. Upon addition of compound I even after a 16 hours period no surface film developed!

EXAMPLE 4.0

To 400 ml of an electrolyte solution having the following composition:

350 g/l nickel sulfate ($NiSO_4.7\ H_2O$)

40 g/l nickel chloride ($NiCl_2.6\ H_2O$)

40 g/l boric acid ($H_3BO_3$)

1 g/l sodium salt of 1,3,6-naphthalenesulfonic acid (basic brightener)

m3 g/l sodium salt of benzoic acid sulfimide (basic brightener)

100 mg/l cocosyldimethylbenzyl ammonium chloride (quaternary ammonium compound II) were added. During the time period of 16 hours the sample was held at a temperature of 55° C. Through floating a film developed on the surface of the solution. This film could easily be detected by means of a slit lamp.

EXAMPLE 4.1

First 3.5 mg/l sulfosuccinic acid dihexyl ester (compound I according to the present invention) were added to the electrolyte solution of example 4.0. After stirring the solution again 100 mg/l cocosyldimethylbenzyl ammonium chloride (quaternary ammonium compound II) were added. The samples were held at a temperature of 55° C. for 16 hours. Through floating a very thin film developed on the surface of the electrolyte solution. This film could just be detected by means of a slit lamp.

EXAMPLE 4.2

First 10 mg/l sulfosuccinic acid dihexyl ester (compound I) were added to the electrolyte solution of example 4.0. After stirring the solution again 100 mg/l cocosyldimethyl benzyl ammonium chloride (quaternary ammonium compound II) were added. The samples were held at a temperature of 55° C. for 16 hours. By means of a slit lamp practically no film could be detected on the electrolyte surface.

Results of examples 4.0, 4.1 and 4.2: Addition of the compound I even at a concentration of 10 mg/l prevented generation of a film which would impair electroplating. Even at a concentration of 3.5 g/l a positive effect could be detected.

What is claimed:

1. Acid nickel or nickel alloy electroplating bath for depositing a satin-finished nickel or nickel alloy coating containing: a nickel containing compound and at least one sulfosuccinic acid compound having the general formula (I)

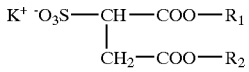

(I)

wherein $R_1$, $R_2$=hydrogen ion, alkali ion, alkaline, earth ion, ammonium ion and/or $C_1$–$C_{18}$ hydrocarbon moiety, wherein $R_1$ and $R_2$ are identical or different with the proviso that at the most one of the groups $R_1$ and $R_2$=hydrogen ion, alkali ion, ammonium ion or alkaline earth ion, and wherein $K^+$=hydrogen ion, alkaline ion, alkaline earth ion, ammonium ion or at least one quaternary ammonium compound, having the following formula (II)

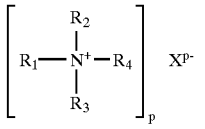

(II)

wherein $R_1$, $R_2$ and $R_3$=hydrogen and/or acyclic $C_1$–$C_{18}$ hydrocarbon moiety, wherein $R_1$, $R_2$ and $R_3$ are identical or different with the proviso that at most two of the moieties $R_1$, $R_2$ and $R_3$=hydrogen;

$R_4$=hydrogen, acyclic $C_1$–$C_4$ hydrocarbon moiety or $C_1$–$C_4$ hydrocarbon moiety substituted with an aromatic group;

$X^{p-}$=monovalent or multivalent anion; and p=an integer.

2. Acid nickel or nickel alloy electroplating bath according to claim 1, wherein at least one of the $C_1$–$C_{18}$ groups of the sulfosuccinic acid compound (I) which is represented by $R_1$, $R_2$, or both $R_1$ and $R_2$, of the formula (I) are acyclic or cyclic hydrocarbon moieties or groups of hydrocarbon moieties bridged via ether groups.

3. Acid nickel or nickel alloy electroplating bath according to claim 1, wherein the at least one sulfosuccinic acid compound is contained in the bath at a concentration of from 0.005 to 5 g/l.

4. Acid nickel or nickel alloy electroplating bath according to claim 1, wherein the at least one sulfosuccinic acid compound is contained in the bath at a concentration of from 0.005 to 0.05 g/l.

5. Acid nickel or nickel alloy electroplating bath according to claim 1, wherein at least one sulfosuccinic acid compound is contained in the bath selected from the group consisting of sulfosuccinic acid dipropyl ester, sulfosuccinic acid dibutyl ester, sulfosuccinic acid dipentyl ester, sulfosuccinic acid dihexyl ester, sulfosuccinic acid dicyclohexyl ester, sulfosuccinic acid dioctyl ester, sulfosuccinic acid dinonyl ester, sulfosuccinic acid monolauryl ester, sulfosuccinic acid dilauryl ester, sulfosuccinic acid monododecenyl ester, sulfosuccinic acid dihexadecyl ester, fatty alcohol polyglycol ether ester of sulfosuccinic acid and sulfosuccinic acid mono(oxodiethoxydodecyl) ester.

6. Acid nickel or nickel alloy electroplating bath according to claim 1, wherein the at least one sulfosuccinic acid compound is one of the salts thereof selected from the group consisting of the potassium salt, the sodium salt, the ammonium salt and the magnesium salt.

7. Acid nickel or nickel alloy electroplating bath according to claim 1, wherein the at least one quaternary ammonium compound is contained in the bath at a concentration of from 0.1 to 100 mg/l.

8. Acid nickel or nickel alloy electroplating bath according to claim 1, wherein additionally at least one basic brightener is contained in the bath at a concentration of from 0.005 to 10 g/l.

9. Acid nickel or nickel alloy electroplating bath according to claim 1, wherein additionally at least one cobalt ion source is contained in the bath.

10. Method for depositing a satin-finished nickel or nickel alloy coating on an electrically conductive work piece, comprising the following method steps:

a. bringing the work piece into contact with the nickel or nickel alloy electroplating bath according to claim 1;

b. bringing at least one anode into contact with the nickel or nickel alloy electroplating bath;

c. applying a voltage across the work piece and the at least one anode; and d. electrodepositing a nickel or nickel alloy coating on the work piece.

11. Method according to claim 10, wherein the nickel or nickel alloy electroplating bath is filtered or circulated continuously or intermittently.

* * * * *